United States Patent [19]

Bowden

[11] Patent Number: 4,741,675

[45] Date of Patent: May 3, 1988

[54] FLOW CONTROL SYSTEM FOR A HYDRAULIC PUMP

[75] Inventor: Charles J. Bowden, Battlecreek, Mich.

[73] Assignee: Hydreco, Incorporated, Atlanta, Ga.

[21] Appl. No.: 892,555

[22] Filed: Aug. 4, 1986

[51] Int. Cl.[4] ..... F04B 49/02; F04B 49/08

[52] U.S. Cl. ..... 417/295; 417/300; 417/310

[58] Field of Search ..... 417/295, 310, 300, 43, 417/26, 282

[56] References Cited

U.S. PATENT DOCUMENTS

| | | | |
|---|---|---|---|
| 822,276 | 6/1906 | Hodsdon . | |
| 1,345,902 | 7/1920 | Vincent . | |
| 1,663,647 | 3/1928 | Brush . | |
| 2,118,180 | 5/1938 | Ferguson . | |
| 2,433,220 | 12/1947 | Huber . | |
| 3,050,004 | 8/1962 | Heintzmann . | |
| 3,449,911 | 6/1969 | Schlosser . | |
| 3,482,768 | 12/1969 | Cirrincione | 417/295 |
| 3,864,059 | 2/1975 | Smith | 417/43 |
| 3,873,239 | 3/1975 | Jamieson | 417/281 |
| 3,935,917 | 2/1976 | Eley | 60/405 |
| 4,118,149 | 10/1978 | Hagberg | 417/26 |
| 4,138,204 | 2/1979 | Bruguera | 417/300 |
| 4,171,188 | 10/1979 | Anderson | 417/282 |
| 4,237,926 | 12/1980 | Wacker | 417/295 |
| 4,345,881 | 8/1982 | Peterson | 417/295 |
| 4,406,589 | 9/1983 | Tsuchida | 417/300 |

FOREIGN PATENT DOCUMENTS

| | | |
|---|---|---|
| 336303 | 10/1933 | Canada . |
| 529652 | 8/1956 | Canada . |
| 622244 | 6/1961 | Canada . |
| 1232757 | 5/1971 | United Kingdom . |
| 1259167 | 1/1972 | United Kingdom . |

*Primary Examiner*—William L. Freeh

*Attorney, Agent, or Firm*—Barnes & Thornburg

[57] ABSTRACT

A hydraulic control system having a supply of low pressure hydraulic fluid and a hydraulic pump having a fluid inlet and a fluid outlet through which fluid is delivered at a high operating pressure when the pump is pumping at its capacity. A valve is placed in fluid communication with the supply of hydraulic fluid and the pump fluid inlet for permitting fluid communication between the supply of hydraulic fluid and the pump fluid inlet when in one mode of operation and for substantially preventing fluid communication between the supply of hydraulic fluid and the pump fluid when in a second mode of operation. A control means prevents the valve from assuming its second mode of operation until the magnitude of the pressure at the pump fluid outlet is below a predetermined pressure. The predetermined pressure is set to be substantially below the pump operating pressure. The valve mounted in the fluid inlet is adapted to rotate therein from a first position in which fluid is free to flow through the fluid inlet to a second position in which the valve substantially prevents the flow of fluid through the inlet. Hydraulically controlled means are provided for rotating the valve back and forth between the first and second positions.

25 Claims, 5 Drawing Sheets

FLOW CONTROL SYSTEM FOR A HYDRAULIC PUMP

BACKGROUND OF THE INVENTION

The present invention relates generally to a hydraulic control system for delivering fluid to one or more fluid actuated devices and more particularly to a hydraulic control system for controlling the flow from a fixed displacement pump to provide the desired amount of output flow when the system is in its working mode and to provide only a minimal amount of lubricating flow when the system is in its non-working mode.

In many applications, a fixed displacement hydraulic pump is mounted on mobile equipment and is driven by the same prime mover which provides the power for the piece of mobile equipment. The fixed displacement pump provides hydraulic fluid under pressure to various fluid actuated devices which are typically utilized only a small portion of the time that the vehicle prime mover, which is typically an internal combustion engine, is operating. It is well known that unless means are provided for disengaging a pump from the vehicle engine two undesirable effects occur. First, engine power is wasted resulting in less economical operation of the engine and, second, the hydraulic circuit becomes a source of significant noise, especially at high engine speeds.

One known solution to the above problems is the use of a large hydraulic pump having sufficient capacity to operate the desired fluid actuated devices when the pump is operated at or near the idling speed of the vehicle engine. In such a system, a clutch is typically provided so that when the vehicle is in motion, the operator may disengage the pump. Alternatively, it is known to use a centrifugal clutch in such a system to disengage the pump at high engine speeds. Such systems have operated successfully but are relatively expensive to manufacture.

Another solution to the above-identified problems is disclosed in U.S. Pat. No. 3,935,917 wherein a pump control system for a gear pump includes means for interrupting the flow of operating fluid to the pump during periods of time when the output of the pump is not required. Thus, theoretically, a pump such as that disclosed in U.S. Pat. No. 3,935,917, would operate only with any residual oil on the surface of the working parts during periods when the output of the pump was not required thereby reducing the load on the vehicle engine and the noise level associated with operating the system. In practice, when utilizing systems of the type disclosed in U.S. Pat. No. 3,935,917 it has been found necessary to place an orifice in the inlet valve to provide some flow through the pump for adequate lubrication of the pump components during periods when the output of the pump is not required. However, such systems still suffer several disadvantages. First, they cause a great deal of hydraulic noise during the brief period when the inlet valve is being closed; second, components have experienced inordinately short life spans; and third, such systems have been housed in relatively large packages thereby wasting space on the vehicle that could be more profitably allotted to other functions.

SUMMARY OF THE INVENTION

Accordingly, a hydraulic control system is provided having a supply of low pressure hydraulic fluid and a hydraulic pump having a fluid inlet and a fluid outlet through which fluid is delivered at a high operating pressure when the pump is pumping at its capacity. A valve is placed in fluid communication with the supply of hydraulic fluid and the pump fluid inlet for permitting fluid communication between the supply of hydraulic fluid and the pump fluid inlet when in one mode of operation and for substantially preventing fluid communication between the supply of hydraulic fluid and the pump fluid when in a second mode of operation a control means prevents the valve from assuming its second mode of operation until the magnitude of the pressure at the pump fluid outlet is below a predetermined pressure. The predetermined pressure is set to be substantially below the pump operating pressure. The valve mounted in the fluid inlet is adapted to rotate therein from a first position in which fluid is free to flow through the fluid inlet to a second position in which the valve substantially prevents the flow of fluid through the inlet. Hydraulically controlled means are provided for rotating the valve back and forth between the first and second positions.

OBJECTS OF THE INVENTION

An object of the present invention is the provision of a hydraulic control system for switching the output of a hydraulic pump between a first mode in which the system operates at a low level of flow and pressure to a second mode in which the system operates at maximum flow and pressure levels.

Another object of the present invention is the provision of a hydraulic control system for controlling the output of a hydraulic pump in a quiet and efficient manner.

A further object of the present invention is the provision of a hydraulic control system for controlling the output flow of a hydraulic pump which is compactly designed so as to occupy a minimum amount of space.

Another object of the present invention is the provision of a hydraulic control system for controlling the output flow of a hydraulic pump which results in improved component life.

Yet another object of the present invention is the provision of a hydraulic control system for controlling the output flow of a hydraulic pump which is relatively easy and inexpensive to manufacture.

Other objects, advantages, and novel features of the present invention will become apparent from the following detailed description of the invention when considered in conjunction with the accompany drawings.

DESCRIPTION OF THE PREFERRED EMBODIMENTS

Figure 1:
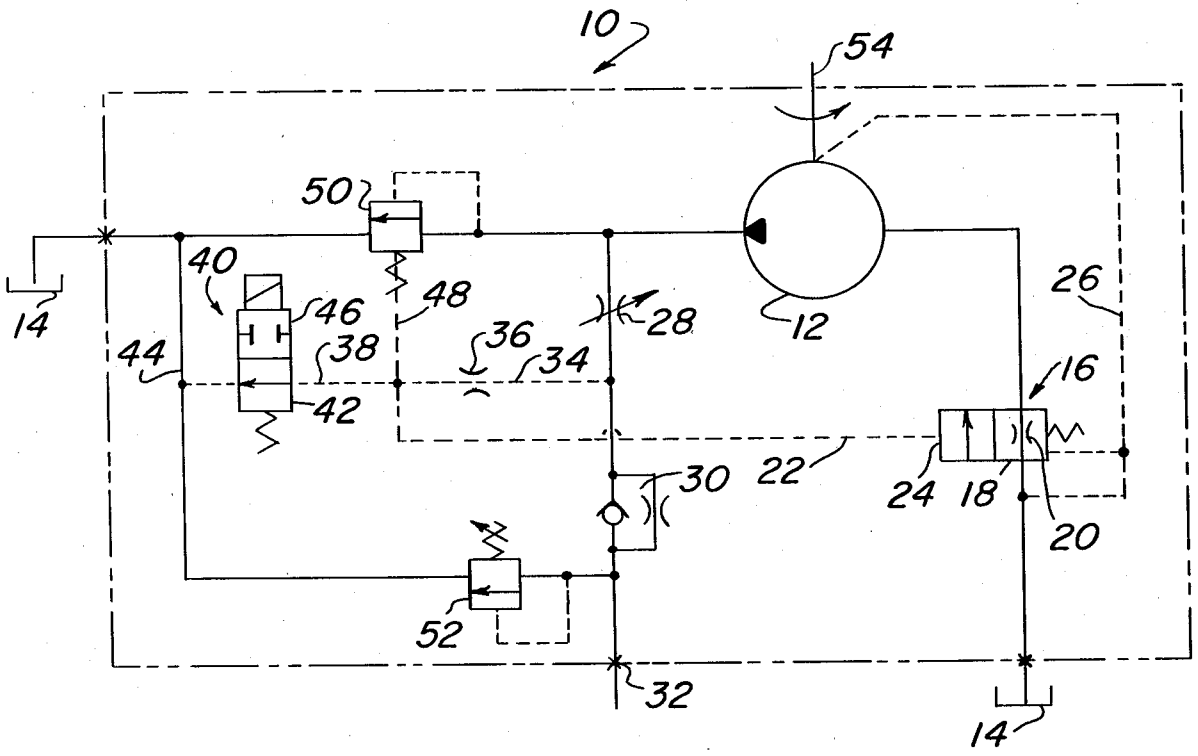
FIG. 1 is a graphic diagram of the hydraulic control system of the present invention.
Figure 2:
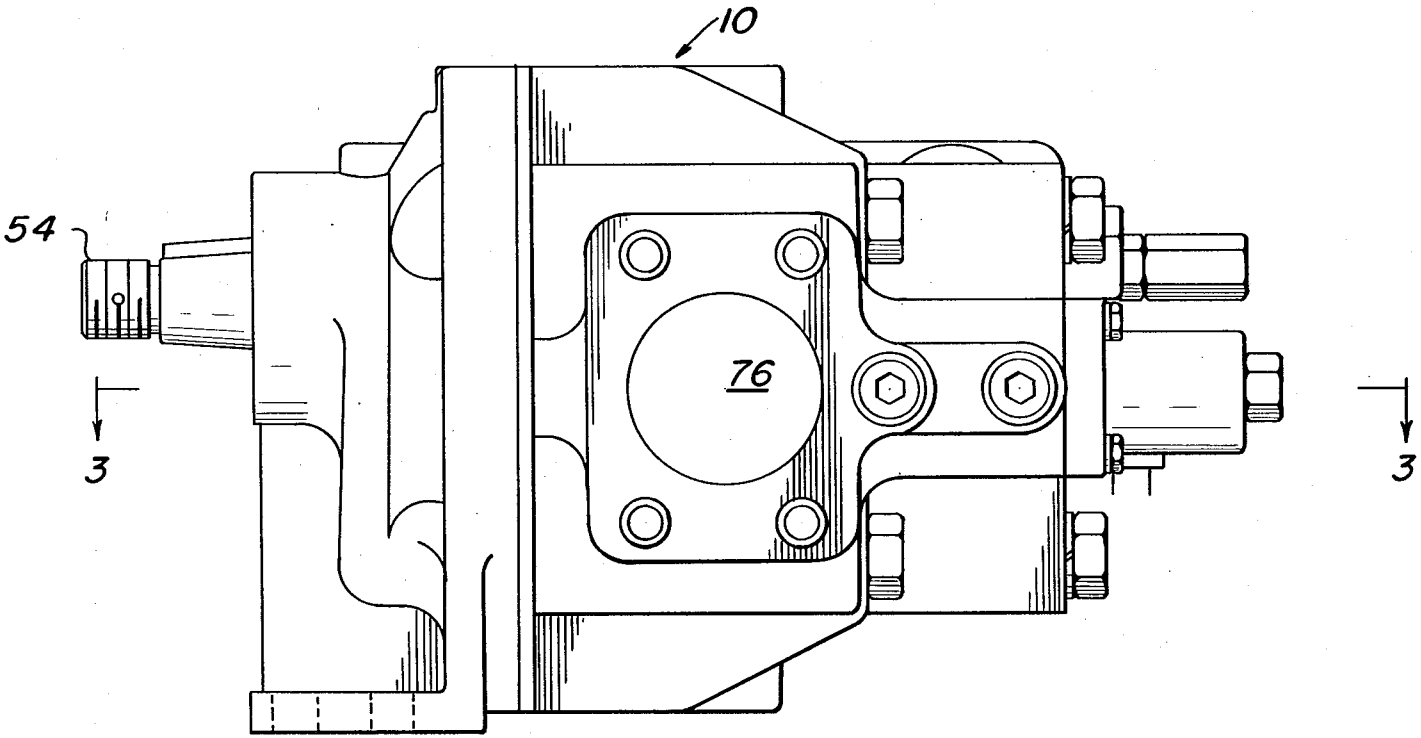
FIG. 2 shows a side view of the hydraulic control system of the present invention.

Referring to FIG. 1, a hydraulic control system 10 is provided for delivering fluid to one or more fluid actuated devices (not shown). The system includes a pump 12, which is preferably a gear pump, having a fluid inlet adapted to be placed in fluid communication with a supply of low pressure hydraulic fluid such as a reservoir 14. The pump 12 is designed to deliver fluid through its fluid outlet at a high operating pressure when the pump is pumping fluid at its capacity. A two position valve 16 is connected in fluid communication with the reservoir 14 and the pump fluid inlet and is preferably located in the pump fluid inlet. The valve 16 is normally spring biased to a first position 18 in which the valve 16 substantially prevents fluid communication between the reservoir 14 and the inlet of pump 12 since the amount of flow is limited by an orifice or restriction 20. In response to a control pressure signal on line 22 having a magnitude above a predetermined pressure, the valve 16 overcomes its spring bias and is shifted into position 24 permitting unrestricted fluid communication between the reservoir 14 and the fluid inlet of pump 12. A line 26 places the pump bearings and seals in fluid communication with the reservoir 14 and also assures that the portion of the valve 16 which is spring biased to the closed position is maintained at reservoir pressure.

The output of pump 12 flows through a variable orifice 28 and a check valve 30 to a fluid outlet port 32 adapted to be connected to one or more fluid actuated devices. The variable orifice 28 is preferably in the form of a needle type valve and the check valve 30 is designed to introduce a small pressure drop into the system as will be more particularly described in connection with FIG. 3. In the event that the hydraulic circuitry downstream of port 32 provides an adequate amount of back pressure, the check valve 30 may be eliminated from the circuit. The variable orifice 28 is part of a control circuit for generating a control pressure signal as will be discussed further herein. The control circuit includes a signal line 34 connected to the low pressure side of the orifice 28. The signal line 34 then passes through a fixed orifice 36 to be distributed to three points in the system. Signal line 22 applies the control pressure signal thus derived, to the valve 16 to overcome the spring bias of that valve and permit fluid communication between the reservoir 14 and the fluid inlet of pump 12 when the magnitude of the control pressure signal exceeds a predetermined pressure. When the magnitude of the control pressure signal is below the predetermined pressure, the valve 16 is spring biased to the closed position wherein fluid communication between the reservoir 14 and the fluid inlet of pump 12 is substantially prevented since it is limited to the amount of flow through orifice 20. Signal line 34 is also in communication with a signal line 38 delivered to valve 40 which is typically actuated by the operator. The valve 40 is preferably electrically actuated but could also be actuated pneumatically, hydraulically or manually. The valve 40 is a two position valve which is normally spring biased to an open position 42 which permits the flow of fluid in signal line 38 to pass through the valve 40 to a line 44 in communication with reservoir 14. When valve 40 is electrically actuated it overcomes its spring bias to assume a closed position 46 preventing the flow of fluid in signal line 38. A signal line 48 is in fluid communication with the signal line 34, the signal line 38, the signal line 22 and a bypass valve 50. The bypass valve 50 is in fluid communication with the fluid outlet of pump 12 and the reservoir 14 and is responsive to the difference between the magnitudes of the pressures of the fluid in the pump fluid outlet and the signal line 48 for diverting the flow of fluid from the pump fluid outlet to the reservoir. The system also includes an over pressure relief valve 52 located downstream of the check valve 30 for placing the output of pump 12 and any fluid actuated devices connected to port 32 in fluid communication with reservoir 14 in the event the pressure at port 32 exceeds a predetermined limit.

To consider the operation of the hydraulic control system of the present invention, it will be assumed that the service port 32 is connected to at least one fluid actuated device (not shown). Assuming the system is in a quiescent state, the electrically actuated valve 40 is unenergized and is therefore spring biased to the open position 42 shown in FIG. 1. The pump 12 is mechanically connected by an input shaft 54 to a prime mover, usually an internal combustion engine (also not shown). Since the signal line 22 is in fluid communication with the reservoir 14, the inlet valve 16 is spring biased to its closed position 18. Likewise the signal on line 48 is in fluid communication with reservoir 14, but since the output from pump 12 is quite small with the inlet valve 16 in its closed position, the bypass valve 50 is also spring biased to its closed position. The relatively small amount of oil drawn by the pump 12 through the inlet orifice 20 in valve 16, for example, approximately 1 gallon per minute, is pumped through the pump fluid outlet through variable orifice 28 and along line 34 through fixed orifice 36, signal line 38, position 42 of valve 40 and line 44 to reservoir 14. This small amount of pump flow is utilized as cooling and lubricating flow for the pump when no fluid is required for the fluid actuated device or devices coupled to port 32. This low level of flow through the system at low pressure results in relatively quiet operation.

When it is desired to provide output fluid at port 32, the operator energizes valve 40 causing it to overcome its spring bias and be placed in the closed position 46. The low level of flow from pump 12 is now directed to check valve 30 which is designed to introduce a sufficient amount of back pressure into the system before opening to raise the pressure on signal line 22 to a sufficient level to cause valve 16 to overcome its spring bias and be forced into the open position 24. If check valve 30 is not utilized in the system, there must be sufficient back pressure inherent in the circuit beyond port 32 to provide this effect. It should be noted that valve 16 thus opens while the system is operating at relatively low pressures. The pump 12 is now placed in full fluid communication with reservoir 14 which permits the pump to assume its full flow capacity.

When it is desired to discontinue activation of the fluid actuated device or devices connected to port 32, the operator deenergizes valve 40 which then once again assumes its open position 42. The flow path from pump 12 through variable orifice 28, line 34, fixed orifice 36, line 38, valve 40 and line 44 to reservoir 14 is now once again reopened. The flow across variable orifice 28 and fixed orifice 36 creates a significant differential pressure between signal line 48 and the pump output pressure. This differential pressure is sensed by bypass valve 50 which is now biased to its open position placing the output from pump 12 in direct fluid communication with reservoir 14 thereby reducing the discharge pressure at the output of pump 12. This drop in pump output pressurre causes the pressure in signal line 22 to drop below the level necessary to maintain the valve 16 in its open position and the valve 16 will be spring biased to close to position 18 thereby reducing the flow of the pump 12 to the cooling and lubrication level of the quiescent state. Once again, it should be noted that the valve 16 closes only after the pressure in the system has been significantly reduced, thereby insuring quiet operation of the valve 16 and the system in general. In a typical system, a control pressure signal on line 22 of 25 pounds per square inch will overcome the spring bias of valve 16 and open that valve and conversely, the spring bias of valve 16 will close the valve when the pressure in line 22 drops below 25 pounds per square inch. This relatively low pressure for opening and closing valve 16 should be contrasted to the normal operating pressure of a typical system of 2000 to 3000 pounds per square inch. Further, in a typical system the bypass valve 50 will be biased to its open position when the differential pressure between signal line 48 and the output of pump 12 exceeds 40 pounds per square inch. In the deactivation portion of the operating cycle of the present invention the bypass valve 50 will open prior to the pressure in signal lines 48 and 22 declining to the threshold pressure of approximately 25 pounds per square inch necessary to close valve 16. Thus valve 16 will be prevented from closing until the pump output pressure drops below approximately 65 pounds per square inch. Conversely, in the activation portion of the operating cycle the pressure in control signal line 22 rises with the pump output pressure and opens valve 16 before the pump output pressure exceeds the threshold pressure of approximately 25 pounds per square inch. During the cooling and lubrication mode, with the valve 16 in its closed position, the pump output pressure is limited to less than the threshold pressure of approximately 25 pounds per square inch. Further, it should be noted that if a check valve 30 is provided as shown, it should be designed to introduce a back pressure of 30 pounds per square inch into the system before opening in order to produce the necessary control signal on line 22.

The aforementioned examples of typical operating and signal pressures are illustrative of the preferred embodiment of the present invention, however, it is within the scope of the present invention to significantly deviate from these pressures, as long as means are provided for preventing the valve 16 from assuming its closed position until the magnitude of the pressure at the outlet of pump 12 drops substantially below the pump operating pressure, preferably 100 pounds per square inch or less.

Figure 3A:
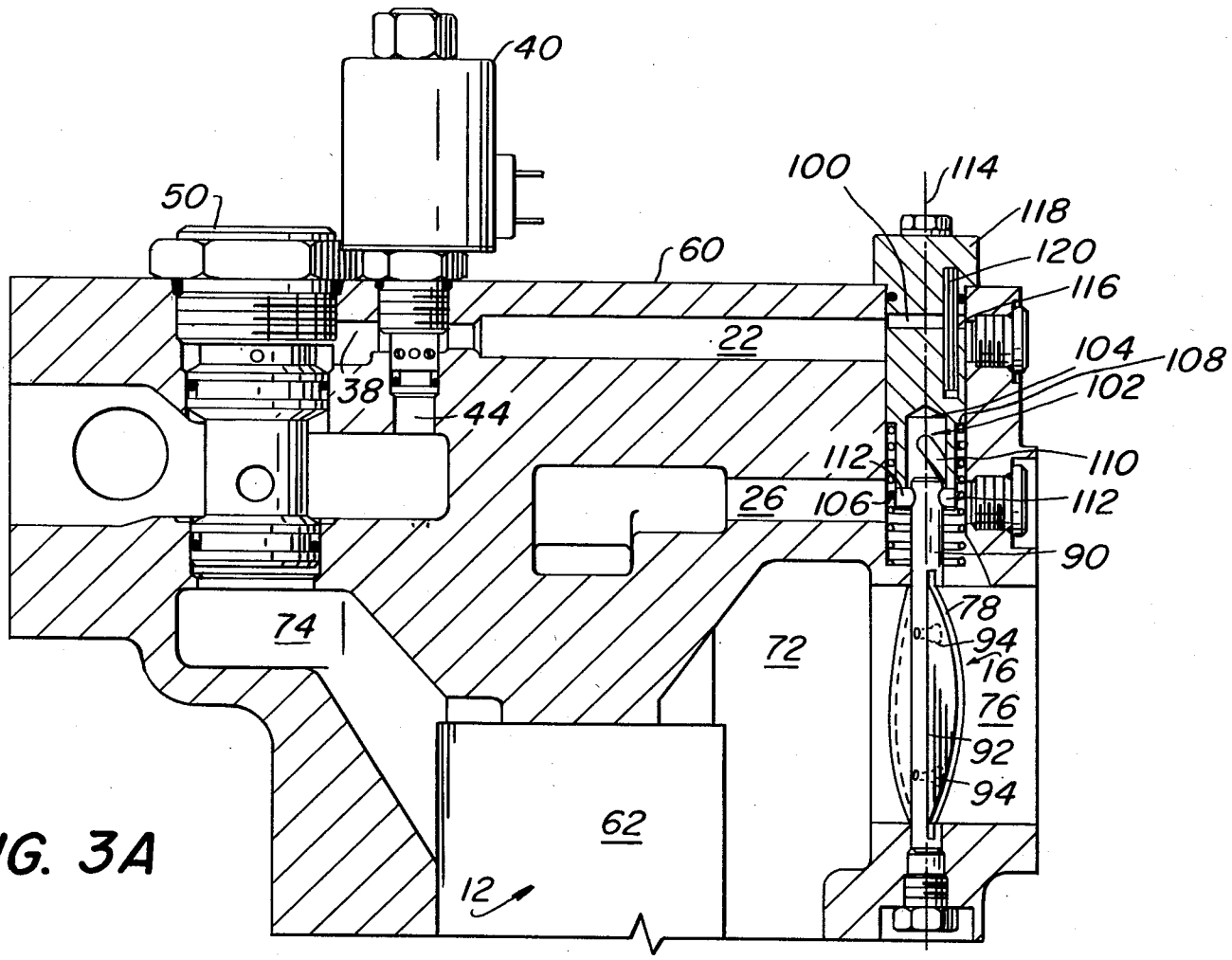
FIG. 3A shows a partial cross-sectional view taken along Line 3—3 of FIG. 2.
Figure 3B:
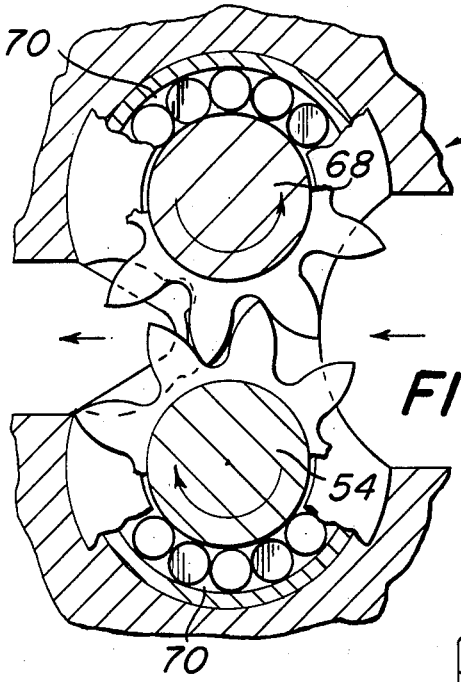
FIG. 3B shows one form of gear pump mechanism suitable for use with the hydraulic control system of the present invention taken in partial cross-section along Line 3B—3B of FIG. 3A.
Figure 3C:
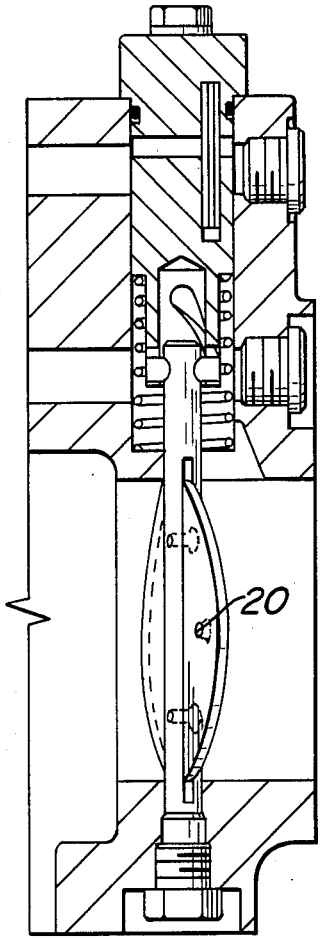
FIG. 3C shows a second embodiment of the hydraulic control system shown in FIG. 3A.
Figure 3D:
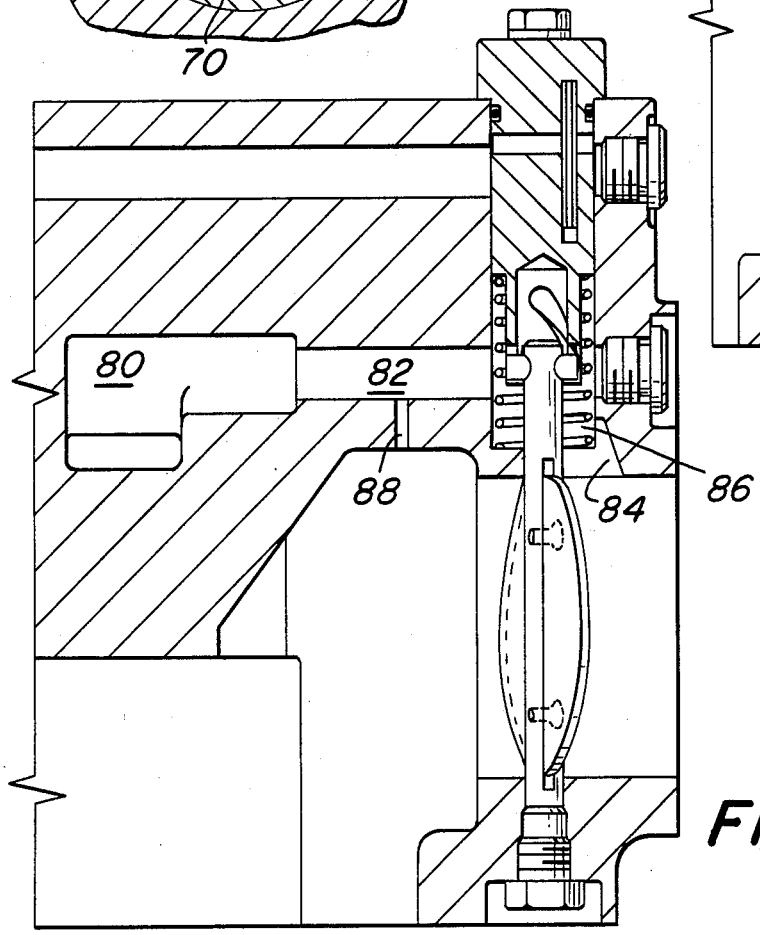
FIG. 3D shows a third embodiment of the hydraulic control system shown in FIG. 3A.

The remaining figures of the drawing show the structural features of the hydraulic control system of the present invention with like components and elements being identified by like numerals. Referring first to FIG. 3A and FIG. 3B, a housing 60 includes a cavity 62 therein for receiving a pumping mechanism 64. The pumping mechanism 64 is preferably of the gear pump type and includes a pair of rotating shafts 54 and 68, with shaft 54 coupled to a prime mover to drive the pumping mechanism. The gear pump mechanism includes a plurality of bearings 70 supporting the rotating shafts 54 and 68. The housing 60 has a fluid inlet 72 and a fluid outlet 74 contained therein. The fluid inlet and fluid outlet are separated from each other in a known fashion by the use of seals (not shown) and by the gear mechanism shown in FIG. 3B. The fluid inlet 72 includes a portion 76 having a circular cross-section. The valve 16 is mounted in the fluid inlet and is adapted to rotate therein from a first position in which fluid is free to flow through the fluid inlet to a second position in which the valve 16 substantially prevents the flow of fluid through the fluid inlet. The valve 16 is preferably a butterfly type valve having a disc shaped valve member 78 having a sufficient diameter to substantially prevent the flow of fluid through the portion of the inlet 76 when the valve 16 is in its closed position. When the valve 16 is in its closed position, the desired amount of cooling and lubricating flow through the pump 12 may be obtained by merely providing a sufficient amount of clearance between the outside edge of the disc shaped member 78 and the walls of portion 76 to provide the desired amount of flow. An alternative way of providing the desired amount of lubricating flow is shown in FIG. 3C wherein one or more orifices 20 are provided in the disc shaped member 78 in addition to or instead of providing clearance around the edge of the member 78. The housing 60 is further provided with a bearing and seal drain cavity 80 in fluid communication with the inlet by means of passageways 82 and 84 and a bore 86 to establish the aforementioned drain line 16. As yet another way of providing the desired amount of lubricating flow, the housing 60 may include an orifice 88 located downstream of the valve 16 for placing the drain passageway 82 in fluid communication with the inlet 72. This alternative embodiment is shown in FIG. 3D.

The valve 16 further includes a pivot rod 90 extending diametrically across the inlet portion 76 and adapted to rotate therein. The pivot rod 90 includes a flattened portion 92 to which the disc shaped valve member 78 is affixed, preferably by means of machine screws 94. The housing 60 further includes a passageway 22 for delivering the control pressure signal mentioned in connection with the description of FIG. 1. A linear actuator 100 is adapted to reciprocate in a linear direction in bore 86 in response to the magnitude of the control signal received from passageway 22. Motion translating means 102 are connected to the valve 16 for converting the linear movement of the linear actuator 100 to rotational movement thereby causing the valve 16 to rotate to its open and closed positions in response to the magnitude of the control signal. The motion translating means includes a bore 104 in the end of the linear actuator 100 facing the pivot rod 90. The linear actuator 100 is spring biased away from the end of pivot rod 90 by a spring 106 seated at one end against the housing 60 in the bottom of bore 86 and at the other end against shoulder 108 on linear actuator 100. The bore 104 includes a pair of helical guides preferably in the form of helical slots 110 in the wall thereof, with each of the helical guides being spaced 180° apart. The pivot rod 90 includes a pair of projections 112 spaced 180° apart on one end thereof, preferably formed by inserting a pin through a hole in the end of rod 90. The projections 112 are adapted to ride in the helical slots 110 as the linear actuator 100 reciprocates to thereby impart rotational motion to the pivot rod 90 to open and close valve 16. Thus the linear actuator 100 acts as a piston assembly which is generally cylindrical in shape and is substantially symmetrical about a central axis 114. In order to prevent the piston assembly from rotating within the housing bore 86, the piston includes a second small bore 116 in its other end. The bore 116 is parallel to but displaced from the central axis 114. A plug 118 closes the bore 86 and a pin 120 is affixed to the plug 118 and extends therefrom into the bore 116. The diameter of the pin 120 is slightly smaller than the diameter of the bore 116 to thereby enable the pin to slide freely in the bore 116 as the piston assembly reciprocates. The action of the pin 120 prevents the linear actuator 100 from rotating within bore 86. The control passageway 22 intersects the bore 86 to thereby provide fluid communication between the passageway 22 and the bore 86 providing hydraulically controlled means for rotating the valve 16 between its open and closed positions.

Figure 5:
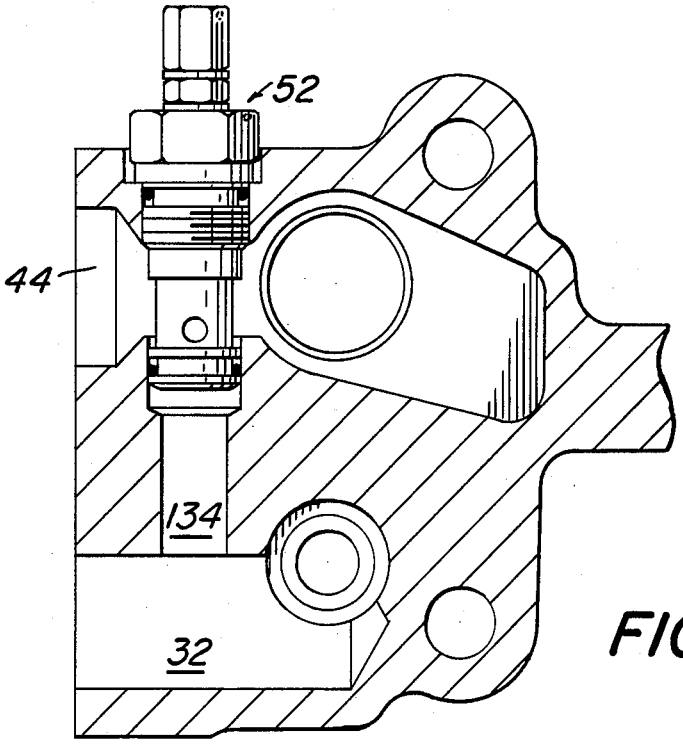
FIG. 5 shows a partial cross-sectional view taken along Line 5—5 of FIG. 3A.

The fluid outlet passageway 74 of pump 12 intersects a passageway 122 of reduced diameter which in combination with a needle valve 123 forms a variable orifice 28. The needle valve 123 includes a body portion 124 and a conical nose 126 whose position may be adjusted by means of a threaded rod 128 attached to the body portion of the valve 123. The threaded rod 128 is typically set at a given position to obtain a desired differential pressure between fluid outlet 74 and signal line 34 when the pump is operating at its capacity. A cap 130 is then fitted over the rod 128 to prevent inadvertent adjustment of the rod 128. The check valve 30 is spring biased by a spring 132 and is in sliding engagement with the needle valve 123 so as to be free to reciprocate thereon. The port 32 is in turn connected to a passageway 134 which is separated from passageway 44 to tank by relief valve 52 as is clearly shown in FIG. 5.

Figure 4:
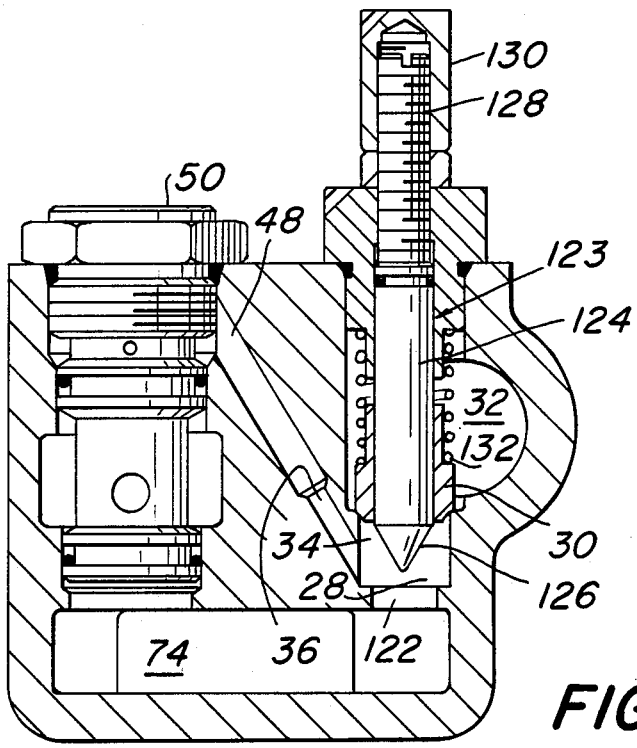
FIG. 4 shows a partial cross-sectional view taken along Line 4—4 of FIG. 3A.

As is best shown in FIG. 4, also downstream of variable orifice 28 is passageway 34 leading to a restricted passageway 36 which forms the fixed orifice referred to earlier. Connected to the fixed orifice 36 is a passageway 48 leading to bypass valve 50 and passageway 38 in turn connected to electrically actuated valve 40.

The fact that the valve 16 opens and closes at relatively low pressures and opens and closes gradually because of its rotating action results in a quiet and efficiently operating system. The valve 16 fits neatly within the system housing without significantly adding to the housing size resulting in a compact design occupying a minimum amount of space. Additionally, the smooth operation of the valve 16 will contribute to improved component life. Finally, the system of the present invention is relatively easy and inexpensive to manufacture.

While there have been described what are at the present considered to be the preferred embodiments of the present invention, it will be obvious to those skilled in the art that various changes and modifications may be made therein, without departing from the invention, and it is, therefore, aimed in the appended claims to cover all such changes and modifications as fall within the true spirit and scope of the present invention.

I claim:

1. A hydraulic control system comprising:

a supply of low pressure hydraulic fluid;

a hydraulic pump having a fluid inlet and a fluid outlet through which fluid is delivered at a high operating pressure when said pump is pumping fluid at its capacity;

a first valve in fluid communication with said supply of hydraulic fluid and said pump inlet for permitting fluid communication between said supply of hydraulic fluid and said pump inlet in a first mode of operation and for substantially preventing fluid communication between said supply of hydraulic fluid and said pump fluid inlet in a second mode of operation; and control means for preventing said first valve from assuming said second mode of operation until the magnitude of the pressure at said pump fluid outlet is below a first predetermined pressure and preventing said first valve from assuming said first mode of operation until the magnitude of the pressure at said pump fluid outlet is above a second predetermined pressure, said first predetermined pressure being substantially below said pump operating pressure and above said second predetermined pressure.

2. A hydraulic control system as set forth in claim 1 wherein said first valve is normally biased to a closed position thereby substantially preventing fluid communication between said supply and said pump fluid inlet.

3. A hydraulic control system as set forth in claim 1 wherein said first predetermined pressure is less than one hundred pounds per square inch.

4. A hydraulic control system as set forth in claim 1 including means for actuating said control means to determine the throughput of said pump when continuously operated by a prime mover.

5. A hydraulic control system as set forth in claim 1, wherein said control means includes first means in fluid communication with said pump outlet for generating a control pressure signal to select the mode of said first valve as a function of the condition of said first means;

second means in fluid communication with said pump outlet for modifying said control pressure signal to prevent said first valve from assuming said second mode until the pressure of said pump outlet is below said first predetermined pressure, and third means in fluid communication with said pump outlet for modifying said control pressure signal to prevent said first valve from assuming said first mode until the pressure at said pump outlet is above said second predetermined pressure.

6. A hydraulic control system as set forth in claim 1 wherein said control means includes signal means in fluid communication with said fluid outlet for generating a control pressure signal, said first valve assuming said first mode of operation when the magnitude of said control pressure signal exceeds a third predetermined pressure and assuming said third mode of operation when the magnitude of said control pressure signal is below said third predetermined pressure, said second predetermined pressure being less than said first predetermined pressure.

7. A hydraulic control system as set forth in claim 6 wherein said third predetermined pressure is less than sixty pounds per square inch.

8. A hydraulic control system as set forth in claim 6, further including a second valve in fluid communication with said pump fluid outlet and said fluid supply and responsive to the difference between the magnitude of the pressure of the fluid in said pump fluid outlet and the magnitude of said control pressure signal for diverting the flow of fluid from said pump fluid outlet to said fluid supply.

9. A hydraulic control system as set forth in claim 7, further including a third valve for permitting a limited amount of flow from said pump fluid outlet to said supply of fluid when said first valve restricts flow to said pump fluid inlet.

10. A hydraulic control system comprising:

a supply of low pressure hydraulic fluid;

a hydraulic pump having a fluid inlet and a fluid outlet through which fluid is delivered at a high operating pressure when said pump is pumping fluid at its capacity;

a first valve in fluid communication with said supply of hydraulic fluid and said pump inlet for permitting fluid communication between said supply of hydraulic fluid and said pump inlet in a first mode of operation and for substantially preventing fluid communication between said supply of hydraulic fluid and said pump fluid inlet in a second mode of operation; and control means for causing said first valve to assume first and second modes of operation, said control means including:

(a) an orifice means in fluid communication with said pump fluid outlet and said first valve, (b) a second valve in fluid communication with said pump fluid outlet and said fluid supply and responsive to the pressure differential across said orifice means for diverting the flow of fluid from said pump fluid outlet to said fluid supply in a first position to permit said first valve to assume said second mode of operation; and (c) third valve means in fluid communication with said supply of fluid and a point between said orifice means and said first valve means for connecting said point to said supply of fluid in a first position to prevent said first valve means from assuming said first mode of operation and to permit said second valve to assume its first position.

11. A hydraulic control system as set forth in claim 10, wherein said orifice means includes a variable orifice and a fixed orifice in series fluid communication.

12. A hydraulic control system as set forth in claim 11, wherein said variable orifice is a needle valve.

13. A hydraulic control system as set forth in claim 11, wherein said third valve is electrically actuated.

14. A hydraulic control system as set forth in claim 11, further including a check valve for permitting the unidirectional flow of fluid from said variable orifice to a fluid outlet port adapted to be connected to a hydraulic load.

15. A hydraulic control system as set forth in claim 14, further including a relief valve connected to a point in said system between said check valve and said outlet port for directing the flow of fluid through said check valve to said supply of fluid when load pressure exceeds a predetermined magnitude.

16. A hydraulic control system comprising:

a housing having a fluid inlet and a fluid outlet contained therein, said fluid inlet including a portion having a circular cross-section;

pump means contained within said housing for delivering hydraulic fluid received at said fluid inlet to said fluid outlet;

a butterfly valve having a disc shaped valve member mounted in said housing in said fluid inlet and adapted to rotate threin from a first position in which fluid is free to flow through said fluid inlet to a second position in contact with said portion of said inlet in which said valve substantially prevents the flow of fluid through said inlet;

signal means in said housing in fluid communication with said fluid outlet for generating a control pressure signal;

a linear actuator in said housing adapted to reciprocate in a linear direction in response to the magnitude of said control signal; and motion translating means in said housing connected to said valve for converting the linear movement of said linear actuator to rotational movement to thereby cause said valve to rotate to its open and closed positions in response to the magnitude of said control signal.

17. A hydraulic control system as set forth in claim 16, wherein said butterfly valve includes means for permitting a lubricating flow of hydraulic fluid through said pump when said valve is in the closed position.

18. A hydraulic control system as set forth in claim 17, wherein said means for permitting a lubricating flow comprises an orifice in said disc shaped valve member.

19. A hydraulic control system as set forth in claim 17, wherein said means for permitting said lubricating flow comprises a small amount of clearance between the outer edge of said disc shaped valve member and said portion of said fluid inlet.

20. A hydraulic control system as set forth in claim 15, wherein said valve includes a pivot rod extending diametrically across said portion of said fluid inlet and wherein said disc shaped valve member is affixed thereto; and wherein said motion translating means includes a bore in one end of said linear actuator, said bore having at least one helical guide in the wall thereof and at least one projection on one end of said pivot rod, said projection adapted to ride in said helical guide as said linear actuator reciprocates to thereby impart rotational motion to said pivot rod to open and close said valve.

21. A hydraulic control system as set forth in claim 20, wherein said bore includes a pair of helical guides 180° apart in the bore wall and at least two projections on said one end of said pivot rod adapted to ride in said helical grooves.

22. A hydraulic control system as set forth in claim 21, wherein said housing includes a control passageway for carrying said control pressure signal and a bore intersecting said control passageway and wherein said linear actuator comprises a piston assembly positioned to reciprocate within said housing bore, said piston assembly including means for preventing said piston from rotating within said housing bore.

23. A hydraulic control system as set forth in claim 22, wherein said piston assembly is generally cylindrical in shape and is substantially symmetrical about a central axis and wherein said means for preventing said piston from rotating within said housing bore comprises a second piston bore in the other end of said piston said second piston bore being parallel to but displaced from said axis, a plug closing said housing bore and a pin engaging said plug and said second bore.

24. A hydraulic control system as set forth in claim 23, wherein said pin is affixed to said plug and is free to slide in said second piston bore as said piston reciprocates.

25. A hydraulic control system comprising:

a housing having a fluid inlet and a fluid outlet contained therein;

a gear pump contained within said housing for delivering hydraulic fluid received at said fluid inlet to said fluid outlet and including a plurality of bearings and seals therein and a drain passageway therein in fluid communication with said bearings and seals and said supply of fluid;

a butterfly valve mounted in said housing in said fluid inlet and adapted to rotate therein from a first position in which fluid is free to flow through said fluid inlet to a second position in which said valve substantially prevents the flow of fluid through said inlet;

an orifice in said butterfly valve located downstream of said valve for placing said drain passageway in fluid communication with said fluid inlet for permitting a lubricating flow of hydraulic fluid through said pump when said valve is in the closed position; and hydraulically controlled means for rotating said valve back and forth between said first and second positions.

* * * * *